US005440985A

United States Patent [19]

Shimmura et al.

[11] Patent Number: 5,440,985

[45] Date of Patent: Aug. 15, 1995

[54] DELIVERY SYSTEM FOR PRINTING PLATE

[75] Inventors: Masatoshi Shimmura, Kanagawa; Yasuo Shibuya, Tokyo; Tooru Higuchi, Kanagawa, all of Japan

[73] Assignee: Kabushiki Kaisha Tokyo Kikai Seisakusho, Japan

[21] Appl. No.: 267,254

[22] Filed: Jun. 29, 1994

[30] Foreign Application Priority Data

Sep. 24, 1993 [JP] Japan ..... 5-238009

[51] Int. Cl.[6] ..... B41F 27/12; B41L 29/14

[52] U.S. Cl. ..... 101/477; 198/408; 271/106

[58] Field of Search ..... 101/477, 216, 415.1; 198/408, 414, 409, 485.1, 486.1, 410, 399; 271/184, 185, 69, 335, 106

[56] References Cited

U.S. PATENT DOCUMENTS

| | | | |
|---|---|---|---|
| 4,874,077 | 10/1989 | Yaguchi et al. | 198/408 |
| 5,176,081 | 1/1993 | Buus | 101/477 |
| 5,289,775 | 3/1994 | Spiegel et al. | 101/477 |
| 5,327,194 | 7/1994 | Doi et al. | 101/477 |
| 5,341,735 | 8/1994 | Hajek | 101/181 |

FOREIGN PATENT DOCUMENTS

| | | | |
|---|---|---|---|
| 197807 | 7/1978 | Germany | 101/477 |
| 59-165659 | 9/1984 | Japan . | |
| 60-52343 | 3/1985 | Japan . | |
| 3184849 | 8/1991 | Japan . | |

*Primary Examiner*—Eugene M. Eickholt
*Attorney, Agent, or Firm*—Ronald P. Kananen

[57] ABSTRACT

A printing plate delivery system for a multi-stage printing press, in which a plurality of printing stages are arranged in vertical direction, comprises a vertical transporting device having a carrier movable in vertical direction between a loading position where a printing plate set along the height direction of the printing press being loaded and a printing plate transfer positions at the corresponding height positions to the printing stages for transferring the printing plate, and receiving device provided corresponding to each of the printing stages and cooperated with the vertical transporting device for receiving the printing plate from the carrier at the corresponding transfer position.

14 Claims, 9 Drawing Sheets

DELIVERY SYSTEM FOR PRINTING PLATE

BACKGROUND OF THE INVENTION

1. Field of the Invention

The present invention relates to a delivery system for delivering printing plates or machine plates to a position near a printing press to place the printing plates in a stand-by state. More specifically, the invention relates to a printing plate delivery system for such printing plates to be used in a printing press, in which a plurality of printing stages are arranged in vertically to form a multi-stage printing press.

2. Description of the Related Art

Printing plate delivery systems have been known as disclosed in Japanese Unexamined Patent Publications Nos. Showa 59-165659 and Showa 60-52343, for example. The delivery systems disclosed in the above-identified publications includes a transporting system extending from a plate processing station to a position near a printing press for transporting processed printing plates to stack near the printing press.

On the other hand, Japanese Unexamined Patent Publication No. Heisei 3-184849 discloses a printing plate delivery system for delivering printing plates to respectively designated plate cylinders in respective vertically-arranged printing stages in the printing press, such as a blanket-to-blanket type printing press. The disclosed system includes a robot arm having an operation head, which is reciprocally movable along an axis of a vertical guide and pivotable about the vertical guide axis for supplying printing plates for the plate cylinders in respective vertically-arranged printing stages located at both sides of the vertical guide.

The above-mentioned conventional printing plate delivery systems are not satisfactory in application for a type of printing press where a plurality of printing stages are arranged vertically for forming a multi-stage printing press. Namely, the delivery systems disclosed in Japanese Unexamined Patent Publications Nos. Showa 59-165659 and Showa 60-52343 are adapted to transport the printing plates to a position near respective ones of the printing presses arranged on a common floor level. Therefore, these printing plate delivery systems have not been designed to deliver the printing plates to vertically-arranged printing stages in the printing press and thus cannot deliver the printing plate to the convenient positions for loading on the plate cylinders in respective vertically-arranged printing stages.

Accordingly, loading of the printing plate on the plate cylinders in the upper printing stages has to be performed manually by personnel by manually bringing the plates to the corresponding floor levels. This requires a substantial work load in carrying the printing plates up and down between the upper and lower floors and thus is quite labor intensive. Furthermore, such manual transportation of the printing plates between a plurality of height levels of floors inherently requires substantial attention for work security. In view of work efficiency and security, improvement has been strongly required.

On the other hand, the printing plate delivery system disclosed in Japanese Unexamined Patent Publication No. Heisei 3-184849 solves the problems the work load and improves work efficiency and security. However, such delivery system requires precision and complex mechanism and relatively highly precise control and thus is quite expensive. Furthermore, such system requires maintenance at relatively high frequency to cause increasing of running cost.

SUMMARY OF THE INVENTION

Therefore, it is an object of the present invention to provide a printing plate delivery system which can solve the problems set forth above.

Another and more specific object of the present invention to provide a printing plate delivery system which can achieve a satisfactory level of work efficiency and security with a capability of delivering printing plates to respective printing stages vertically-arranged in a printing press, while both production cost and running cost are maintained relatively low.

According to one aspect of the invention, a printing plate delivery system for a multi-stage printing press, in which a plurality of printing stages are arranged in a vertical direction, comprises:

a vertical transporting means having a carrier movable in a vertical direction between a loading position where a printing plate is set along the height direction of the printing press being loaded and a printing plate transfer position at the corresponding height position to the printing stages for transferring the printing plate; and receiving means provided corresponding to each of the printing stages and cooperated with the vertical transporting means for receiving the printing plate from the carrier at the corresponding transfer position.

The printing plate delivery system may further comprise a temporary holding means for temporarily holding the printing plate transferred to the receiving means.

In the preferred construction, the receiving means incorporates the temporary holding means.

According to another aspect of the invention, a printing plate delivery system for a multi-stage printing press, in which a plurality of printing stages are arranged in a vertical direction, comprises:

a vertical transporting means having a carrier movable in a vertical direction between a loading position where a printing plate is set along the height direction of the printing press being loaded and a printing plate transfer position at the corresponding height position to the printing stages for transferring the printing plate;

receiving means provided corresponding to each of the printing stages and cooperated with the vertical transporting means for receiving the printing plate from the carrier at the corresponding transfer position; and horizontal transporting means corresponding to each receiving means at the position corresponding to each printing stage and cooperated with the receiving means for transporting the printing plate substantially in a horizontal direction.

In the preferred construction, the horizontal transporting means is incorporated in the receiving means. The horizontal transporting means may transport the printing plate in a direction which is substantially parallel to a longitudinal axis of a plate cylinder in the printing stage.

The printing plate delivery system may further comprise a temporary holding means for temporarily holding the printing plate horizontally transported by the horizontal transporting means.

According to a further aspect of the invention, a printing plate delivery system in a printing press having a plurality of printing stages arranged vertically for delivering printing plates to plate cylinders in respective printing stages, comprises:

a vertical transporting passage extending vertically in the vicinity of the printing press across a first printing plate loading position and a plurality of first printing plate unloading positions which correspond to respective height positions of the plate cylinders and defining a printing plate transporting passage;

at least one vertical carrier device movable along the vertical transporting passage across the first printing plate loading position and printing plate unloading positions while carrying the printing plate loaded at the first printing plate loading position for delivering at a desired one of the printing plate unloading positions;

a plurality of horizontal transporting passages each extending in a substantially horizontal direction along the longitudinal axis of the printing cylinder at each printing stage across the unloading position; and a plurality of horizontal carrier devices each movable along the horizontal transporting passage between a second printing plate loading position corresponding to the first printing plate unloading and a second unloading position position for transporting the printing plate transferred from the vertical carrier device to desired horizontal position while opposing the printing plate with the plate cylinder and transfer to the plate cylinder.

The vertical carrier device may carry the printing plate while directing the printing plate in an angled orientation with respect to a plane extending across the longitudinal axis of the plate cylinder, and the horizontal carrier device may carry the printing plate while directing the printing plate in a substantially parallel orientation with respect to the plane, and in such construction, the system may further comprise an orienting mechanism interposed between the vertical carrier device and the horizontal carrier device for converting orientation of the printing plate from the angled orientation to the parallel orientation. The orienting mechanism may be incorporated in the vertical carrier device for pivoting the carrier device between the angled position and the parallel position together with the printing plate. Alternatively, the orienting mechanism may be incorporated in the horizontal carrier device for reorienting the printing plate from the angled position to the parallel position.

A plurality of the vertical carrier devices may be movably supported on the vertical transporting passage in a mutually spaced apart relationship for permitting a one-way circulating movement of the vertical carrier devices across the first loading position and the first unloading position. On the other hand, a plurality of the horizontal carrier devices are arranged so that one of the horizonal carrier devices is selectively placed at the second loading position for receiving the printing plate.

BRIEF DESCRIPTION OF THE DRAWINGS

The present invention will be understood more fully from the detailed description given herebelow and from the accompanying drawings of the preferred embodiment of the present invention, which, however, should not be taken to limit to the invention, but are for explanation and understanding only.

In the drawings.

DESCRIPTION OF THE PREFERRED EMBODIMENT

The present invention will be discussed hereinafter in detail with reference to the accompanying drawings.

Figure 1:
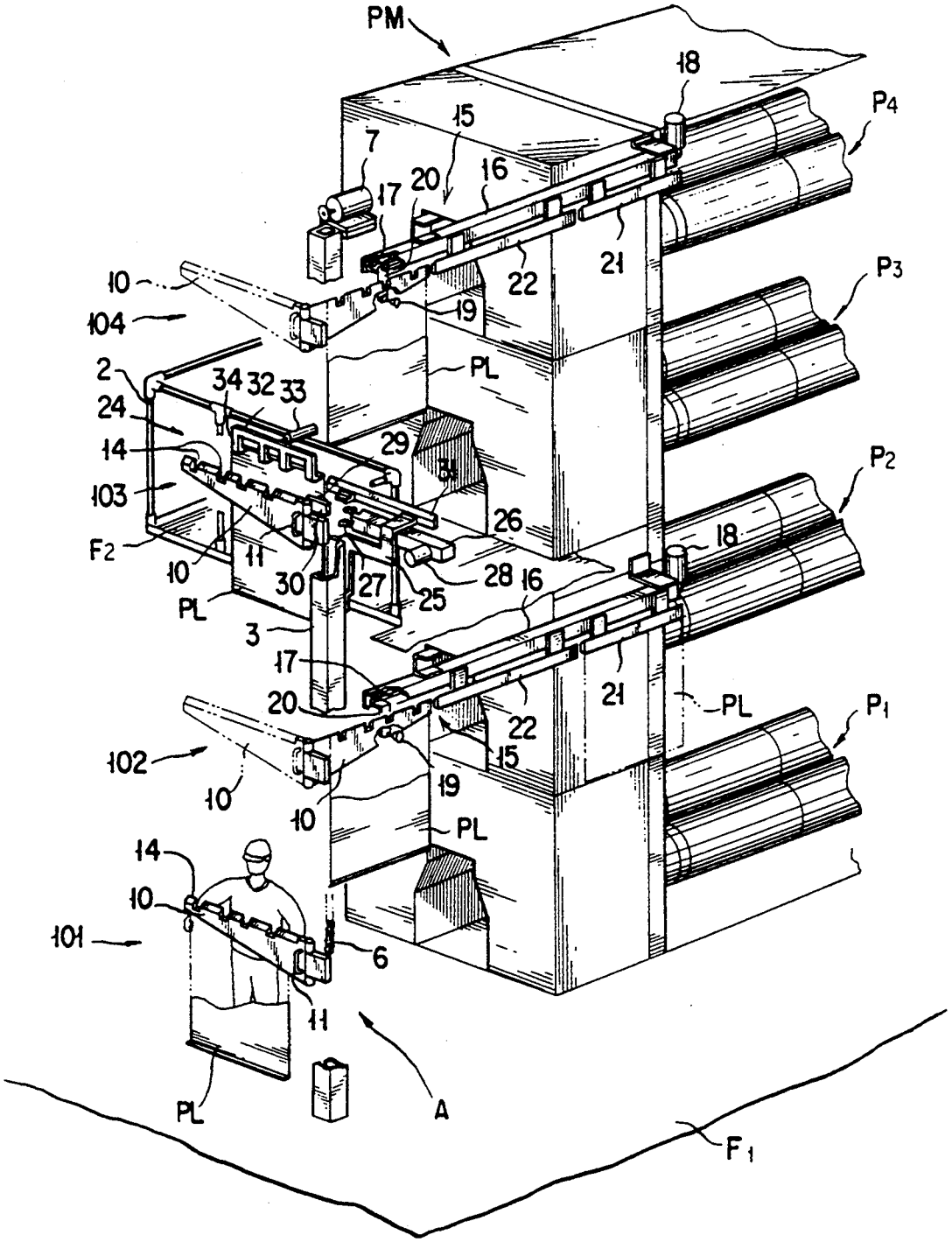
FIG. 1 is a perspective view of a part of a multi-stage printing press where a plurality of printing stages are arranged vertically and the preferred embodiment of a printing plate delivery system is applied.

In FIG. 1, PM generally denotes a multi-stage printing press, to which a printing plate delivery system according to the present invention is applicable. The printing press PM herewith disclosed is a blanket-to-blanket type multi-stage printing press having a plurality of vertically-arranged pairs of printing stages $P_1$, $P_2$, $P_3$ and $P_4$. The number of printing stages to be vertically-arranged should not be specific to be four as illustrated but can be more or less as required. In FIG. 1, only printing stages arranged at one side are shown for purpose of illustration. Also, although it is not shown in FIG. 1, working platforms extending in the longitudinal direction of plate cylinders are provided at elevations corresponding to the printing stages $P_2$ and $P_4$. On the other hand, a lower floor $F_1$ is provided at the elevation corresponding to the elevation of the lowermost printing stage $P_1$. An upper floor $F_2$ is provided at the elevation corresponding to the elevation of the third level printing stage $P_3$. The elevations and numbers of the working platforms and the floors are not specific to the shown embodiment but can be arbitrarily selected for convenience in the plate loading operation. For the purpose of security, a handrail 2 is provided in the upper floor $F_2$.

Figure 3:
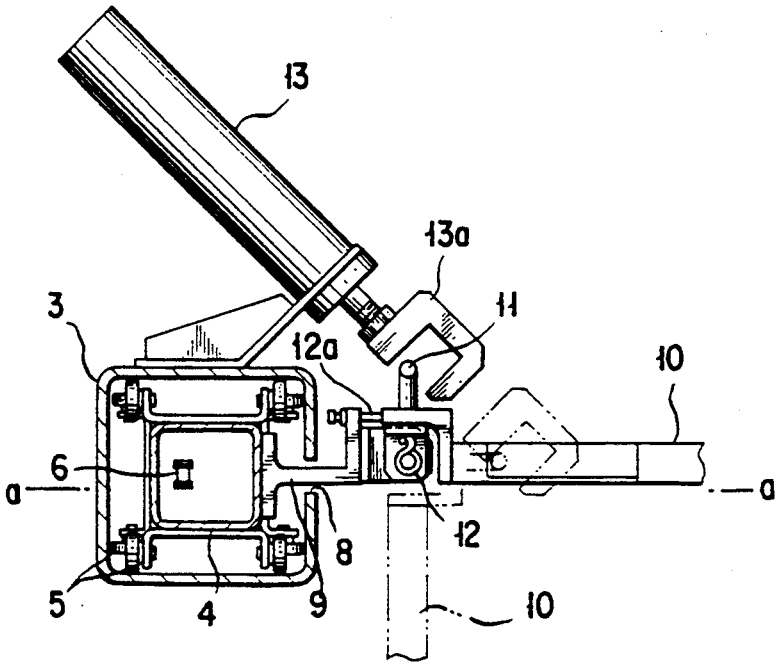
FIG. 3 is a cross section of an angular displacement mechanism for a carrier employed in the embodiment of FIG. 1.
Figure 4:
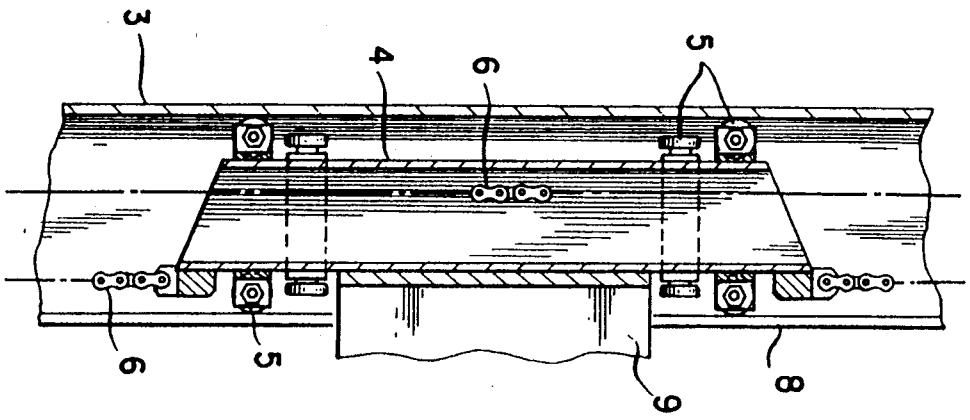
FIG. 4 is a section taken along line a—a of FIG. 3.

A carrier support 3 is extended from the lower floor $F_1$ throughout the height levels of the respective printing stages $P_1$ to $P_4$. The carrier support 3 is positioned horizontally outside of the handrail 2 on the upper floor $F_2$. On the carrier support 3, a vertically-orientated transporting means A is supported for vertical reciprocal movement while carrying a printing plate PL. The detail of the vertically-orientated transporting means A is illustrated in greater detail in FIG. 3. As shown in FIG. 3, the vertically transporting means A includes an elevating body 4 carrying rollers 5 contacting onto the inner periphery of the carrier support 3 for vertical reciprocation. The elevating body 4 is coupled with a chain 6 extending along the carrier support 3. The chain 6 is drivingly coupled with a drive means (i.e., an electric motor) 7 located at the upper end of the carrier support 3.

In one side of the carrier support 3, a slit 8 is formed. The slit 8 extends in the longitudinal direction of the carrier support 3. A bracket 9 carried by the elevating body 4 extends through the slit 8 in an orientation substantially perpendicular to the longitudinal direction of a plate cylinder in the respective printing stages $P_1$ to $P_4$. The bracket 9 pivotally supports a carrier 10 which is designed to carry the printing plate PL, at its tip end. The carrier 10 is pivotable between an initial position, at which it is oriented perpendicular to the longitudinal direction of the plate cylinder, and a pivoted position pivoted about 90° from the initial position and oriented substantially parallel to the longitudinal axis of the plate cylinder. A projecting actuation member 11 is provided at the pivoted end of the carrier 10 for causing pivotal movement of the carrier with the force exerted thereto. On the other hand, the carrier 10 is normally biased by means of a spring 12 provided at the pivoting portion toward the initial position. Therefore, while no force is exerted on the projecting actuation member 11, the carrier 10 is held at the initial position by the action of the spring 12. At this moment, a stopper 12*a* is put to the end of bracket 9.

On the outer surface of the carrier support 3, carrier pivoting means (i.e., air cylinders) 13 are mounted at the elevations respectively corresponding to the second and fourth stage printing stages $P_2$ and $P_4$, which carrier pivoting means are not illustrated in FIG. 1 but shown in FIG. 3. The height positions corresponding to the second and fourth printing stages $P_2$ and $P_4$ will be hereinafter referred to as "second stage position 102" and "fourth stage position 104", and are printing plate transfer positions. An actuation member 13*a* of each carrier pivoting means 13 is formed into a yoke configuration to engage with the projecting actuation member 11 of the carrier 10 when the carrier reaches the second stage position 102 and the fourth stage position 104.

The carrier 10 has an upper end edge formed into a wedge-shaped configuration with a plurality of cut-outs 14. With this construction, when the carrier 10 is placed at the height position corresponding to the lower floor $F_1$ and oriented at the initial position, the printing plate PL is hung to the carrier 10 at the upper end thereof as illustrated in FIG. 1. The height position corresponding to the lower floor $F_1$ will be hereinafter referred to as "printing plate loading position 101".

In the second stage position 102 and the fourth stage position 104, printing plate receiving devices 15, 15 of an identical construction are provided in a parallel relationship to the plate cylinders in the printing stages $P_2$ and $P_4$.

Each of the printing plate receiving devices 15 includes a receiving carrier beam 16 which is fixed and projected toward the carrier support 3, an endless chain 17 provided along the receiving carrier beam 16, a drive means 18 for driving the chain 17, and a receiving carrier 20 mounted on the chain 17 while externally exposing an exposed portion from the receiving carrier beam 16 and having a printing plate receiving member 19 (for example, a sucker member connected to a not shown vacuum device) on the exposed portion. The receiving carrier beam 16 further includes a temporary holding member 21 for temporarily holding the printing plate PL on the printing press side and a support rail 22 positioned between the carrier 10 in the pivoted condition and the temporary holding member 21.

Figure 5:
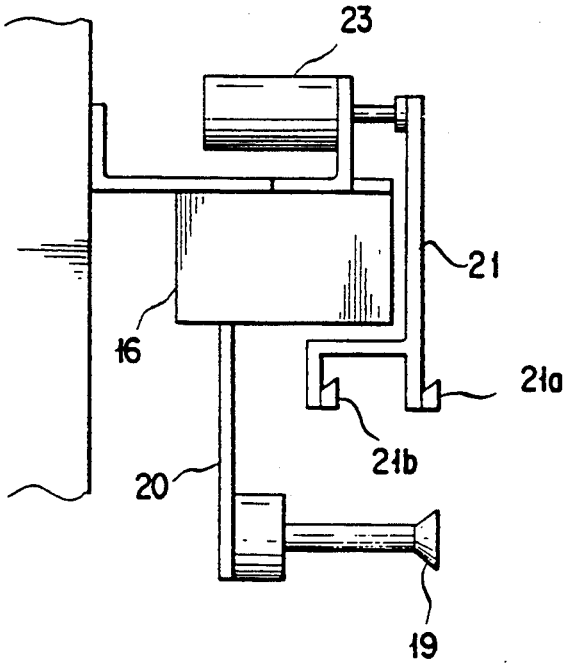
FIG. 5 is a side elevation showing a mechanism in the case where a temporary holding member is overlapped in the embodiment of FIG. 1.

While the temporary holding member 21 is constructed to be mounted on one of the receiving carrier beams 16 in the embodiment illustrated in FIG. 1, it may be possible to provide a plurality of temporary holding members 21*a*, 21*b* in an overlapping manner in a back-and-forth direction for selectively arranging these temporary support members 21*a* and 21*b* at the position corresponding to the end of the support rail 22 by means of the drive means 23, as shown in FIG. 5. It should be appreciated that the number of the supporting members to be provided in overlapping manner may be arbitrarily determined depending upon necessity.

At the third stage position 103 (FIG. 1) as a receiving portion corresponding to the height level of the third stage printing stage $P_3$, in which the upper floor $F_2$ is provided, the handrail 2 is provided as set forth above. This handrail 2 interferes with pivotal motion of the carrier 10. So that the printing plate PL for the third stage printing stage $P_3$ and supported by the carrier 10 can be transferred to the printing stage $P_3$ at the third stage position 103, another printing plate receiving device 24 is provided. For the purpose set forth above, the printing plate receiving device 24 is oriented to be perpendicular to the longitudinal direction of the plate cylinder in the printing stage $P_3$ at the position offset toward the printing press from the carrier position 10.

The printing plate receiving device 24 is generally constructed with the same construction as the printing plate receiving device 15. Therefore, the printing plate receiving device 24 includes a receiving carrier beam 26 mounted on the carrier support 3 via a bracket 25, an endless chain 27 provided along the receiving carrier beam 26, a chain driving means 28 for driving the chain 27, and the receiving carrier 30 mounted on the chain 27 while externally exposing an exposed portion from the receiving carrier beam 26 and having a printing plate receiving member 29 (for example, a sucker member connected to a not shown vacuum device) on the exposed portion. On the bracket 25, a temporary holding member 31 is provided for temporarily holding the printing plate PL in parallel to the receiving carrier beam 26 at the corresponding position, i.e. in the initial position.

The temporary holding member 31 may be provided in plural in the overlapping manner as in the case of the printing plate receiving device 15 so as to be selectively arranged to a transfer position to a transfer member 32.

The transfer member 32 is adapted for parallel movement between a printing plate receiving position for receiving the printing plate PL from the carrier 10 in the initial position and a printing plate transferring position for transferring the printing plate to the receiving carrier beam 26 by means of a driving means 33 (an air cylinder with an intermediate stop function, in the shown embodiment). The transfer member 32 is provided with a rake-shaped projecting portion 34 which corresponds to the cut-outs 14 of the carrier 10 and adapted to receive the printing plate PL therefrom.

In the alternative construction, the printing plate receiving device 24 may be constructed such that the transfer member 32 with the driving means 33 therefor are mounted on the receiving carrier 30 with an appropriate means to transfer the printing plate PL received from the carrier 10 and then directly transfer the printing plate P1 from the transfer member 32 to the temporary holding member 31 with a directly transferring mechanism (not shown), in place of the printing plate receiving member 29. When such mechanism is employed, at least one of the temporary holding member 31 and the transfer member 32 may be movable in a vertical direction and cut-outs corresponding to the rake-shaped projecting portion of the transfer member 32 may be provided in the temporary holding member 31. Also, in such case, the printing plate receiving device 24 may include a mechanism (not shown) for avoiding interference upon transfer of the printing plate between the temporary holding member 31 and the transfer member 32.

Figure 6:
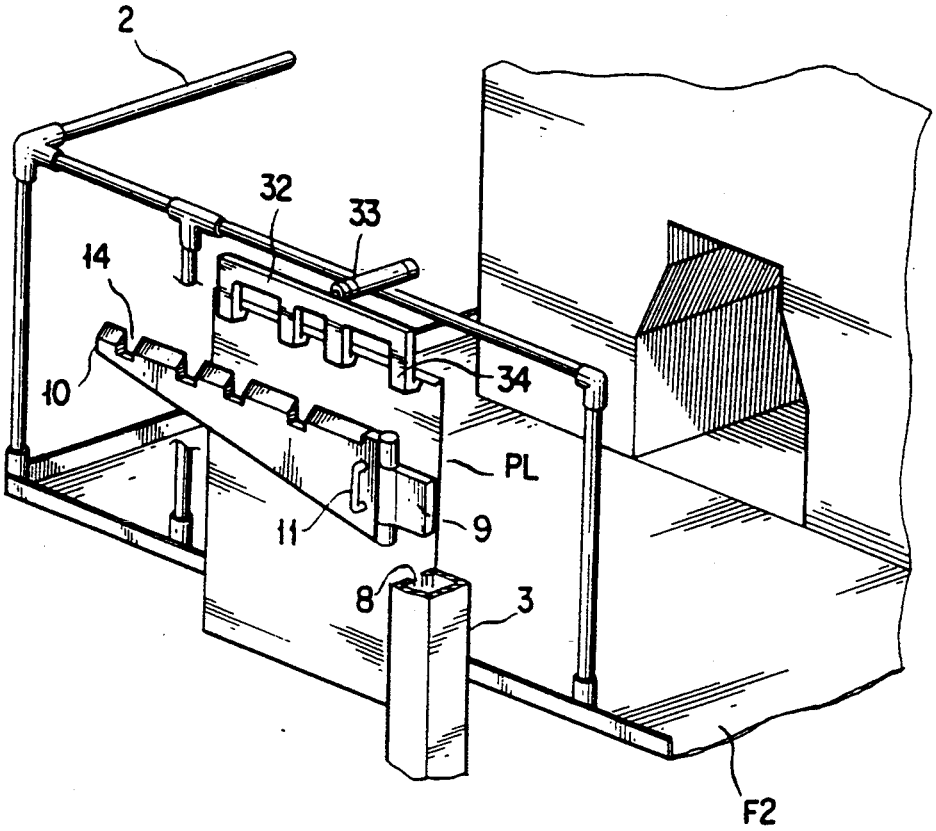
FIG. 6 is a perspective view of another embodiment of a printing plate receiving device in the embodiment of FIG. 1.

Furthermore, the printing plate receiving device 24 may be constructed only with the transfer member 32 and the driving means 33 so that the transfer member 32 maintains the printing plate PL received from the carrier 10 to carry the printing plate along the receiving carrier beam 26, as shown in FIG. 6.

In the embodiment illustrated in FIG. 1, it may be possible to construct the printing plate receiving device for the printing stage $P_3$ at the third stage where the upper floor $F_2$, identical to the construction of the printing plate receiving device of the second and fourth stages, by modifying the construction of the handrail 2 so as not to interfere with pivotal motion of the carrier 10.

Figure 2:
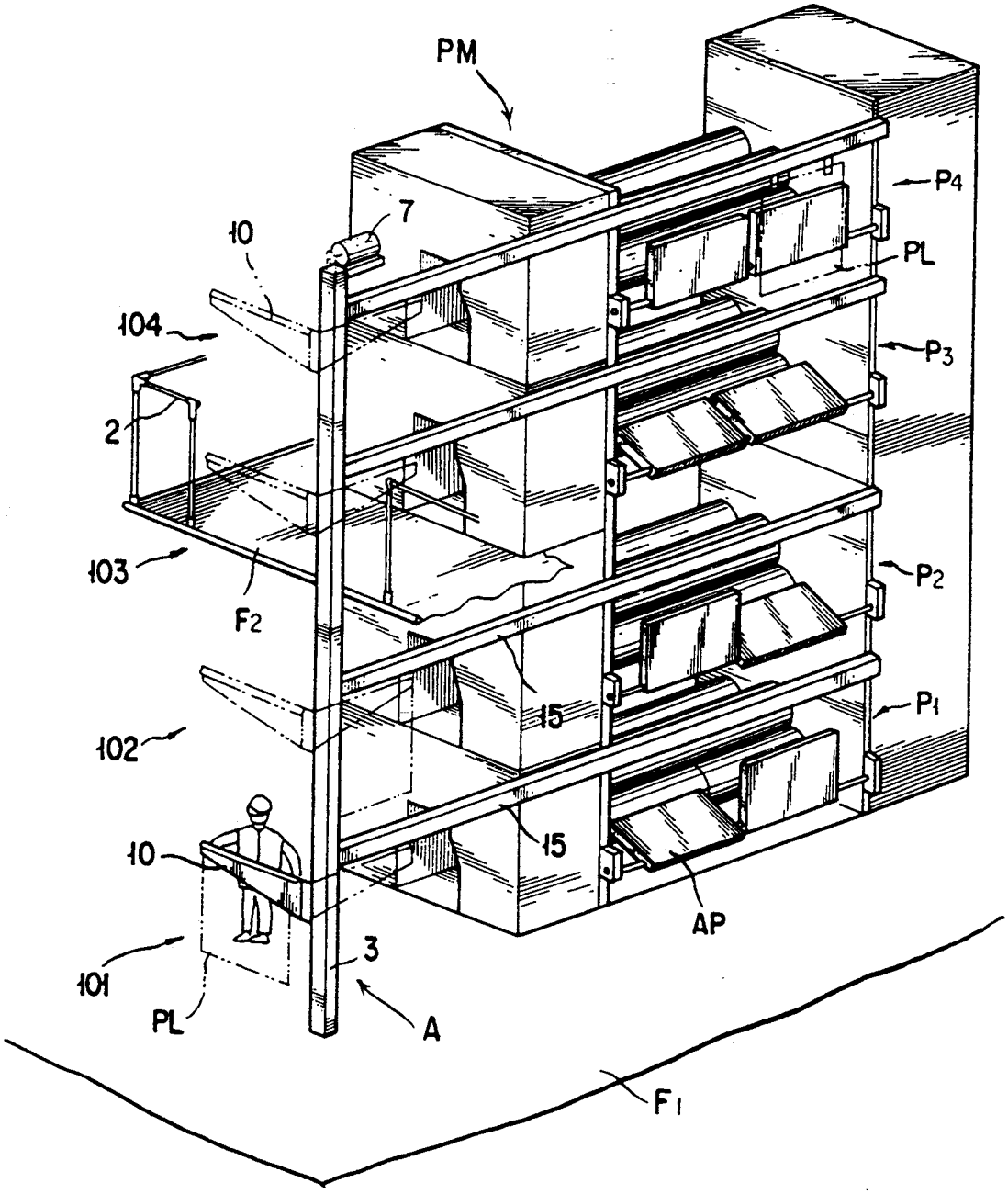
FIG. 2 is a perspective view similar to FIG. 1, but shows another embodiment of a printing plate delivery system applied to the multi-stage printing press.

FIG. 2 shows another embodiment of the printing plate delivery system according to the present invention. FIG. 2 shows the embodiment, in which the vertical transporting means A similar to that illustrated in FIG. 1 is provided. The carrier 10 of the vertical transporting means A is pivoted over approximately 90° at the lowermost printing plate loading position 101 and second and subsequent upper stage positions 102, 103 and 104 for transferring the printing plate PL to the printing plate receiving devices 15. In this embodiment, the printing plate PL received by each printing plate receiving device 15 can be transported to a printing plate loading position in the vicinity of the plate cylinder at each stage of the printing stage.

With this construction, the printing plate delivery system may be cooperated with an automatic printing plate loading device AP.

Figure 8:
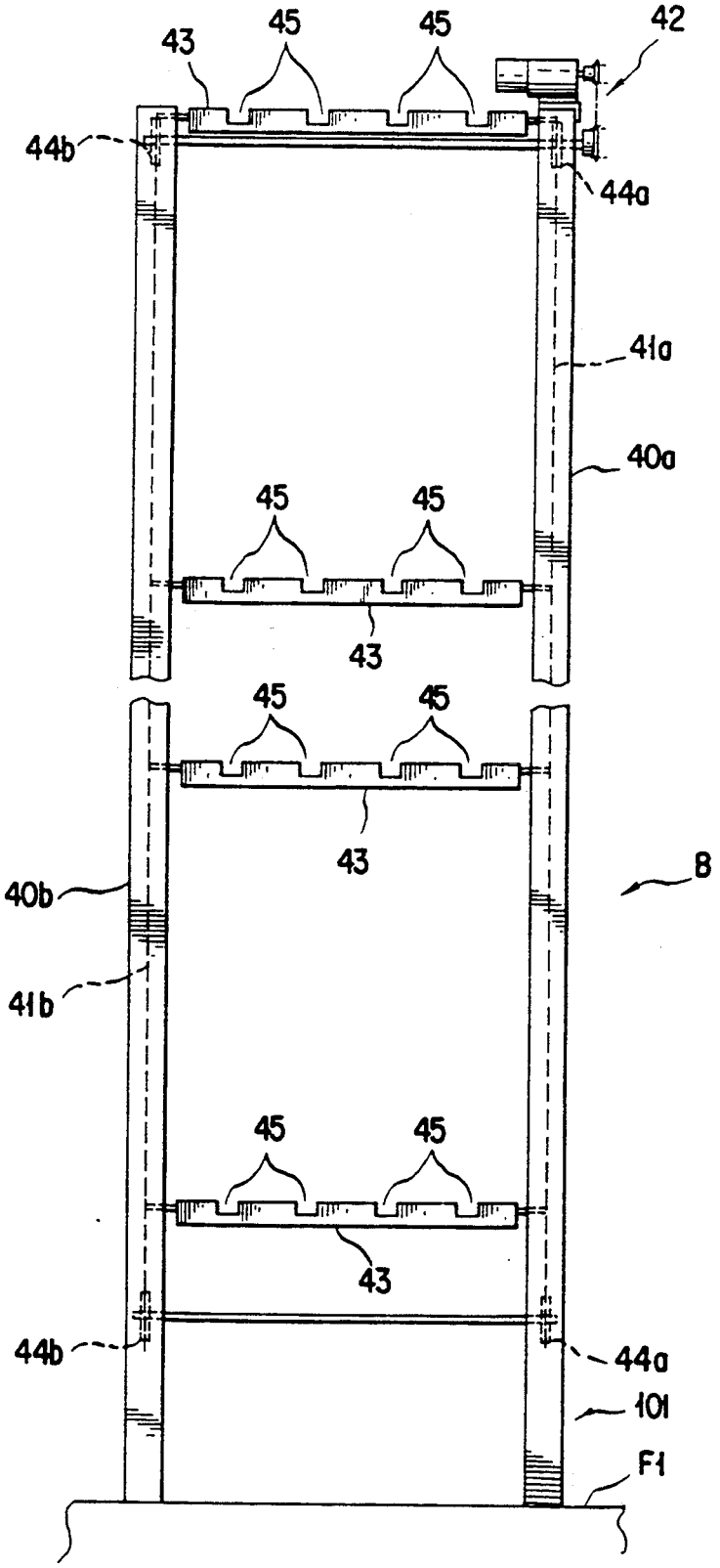
FIG. 8 is a perspective view showing a modified construction of a vertical transporting means in the embodiment of FIG. 1.

In the respective embodiment set forth above, the carrier 10 of the vertical transporting means A is supported in cantilever fashion and the elevating chain 6 is coupled with the supporting member for the carrier. In this construction, once the printing plate PL carried by the carrier is transferred to the printing plate receiving device 15 or 24, the driving means 7 is driven in the reverse direction to rerun the carrier 10 to the initial printing plate loading position 101 at the lower floor $F_1$. FIG. 8 shows a modified embodiment for the vertical transporting means.

In FIG. 8, the modified construction of the vertical transporting means is generally represented by the reference sign B. The vertical transporting means B includes a pair of carrier supports 40*a* and 40*b*. A pair of chains 41*a* and 41*b* are provided along the carrier supports 40*a* and 40*b*. The chains 41*a* and 41*b* are driven in synchronism with each other by means of a driving means 42. A plurality of carriers 43 are provided between the pair of chains 41*a* and 41*b* while mounting one end to the chain 41*a* and the other end to the chain 41*b*. Each carrier 43 thus extends substantially perpendicular to the carrier supports 40*a* and 40*b*. The carriers 43 are mutually spaced apart from each other with an appropriate clearance therebetween in the traveling direction thereof. The vertical transporting means B is designed to cooperate with the printing plate receiving device 24 or other printing plate receiving devices equivalent thereto.

The chains 41*a* and 41*b* are constructed to be constantly driven in one direction across sprocket wheels 44*a*, 44*a* and 44*b*, 44*b* for circulation. The carriers 43 carried by such chains 41*a* and 41*b* thus circulate across the positions where the sprocket wheels 44*a*, 44*a* and 44*b*, 44*b* are provided. Therefore, the carriers 43 pass across respective printing plate transferring positions 102, 103 and 104 and return to the initial printing plate loading position 101 in a one-way movement.

In case of the vertical transporting means B in the embodiment of FIG. 2, the temporary holding member for temporarily holding the printing plate, in the printing plate receiving device may be provided on both of the carrier supports 40*a* or 40*b* so as to temporarily hold printing plates for plate cylinders at both sides of the vertical transporting means B.

Figure 9:
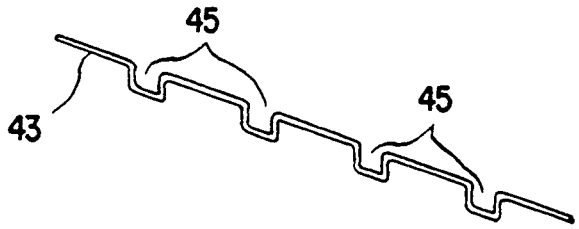
FIG. 9 is a front elevation of another carrier applicable for the vertical transporting means in the embodiment of FIG. 8.

The carrier 43 is formed with a plurality of cut-outs 45. On the other hand, in place of the cut-outs 45, it is possible to provide a rod member bent to define recesses as shown in FIG. 9 on the carriers 43 for performing a similar effect to the cut-outs 45. It is further possible to mount the carriers 43 on the chains 41*a* and 41*b* in a rotatable manner for permitting rotation of the carriers 43 about the longitudinal axes thereof.

On the other hand, in case of the vertical transporting means B, in which the carrier 43 cannot move downwardly upon transferring of the printing plate to the printing plate receiving device 24, the transfer means 32 of the printing plate receiving device 24 which cooperates with the vertical transporting means B may be designed for vertical movement by means of not shown actuation means, such as an air cylinder.

The operation of the embodiments of the printing plate delivery systems as set forth above will be discussed hereinafter.

In response to an initiation signal for the printing plate delivery system, a not shown control means is started up. Then, with an appropriate means, such as manual operation by the personnel, the printing plate PL is loaded to the carrier 10 or 43 of the vertical transportation means A or B placed at the printing plate loading position 101.

Subsequently, one of the stage positions 102, 103 or 104 is designated as the receiving position, to which the printing plate PL is transported by the carrier 10 or 43. The control means then outputs a control signal. Designation of the one of the stage positions 102, 103 and 104 can be performed by manual switch operation by the personnel, or by reading information on the back side of the printing plate PL in a form of character or code sign, such as bar code by means of appropriate reader equipment (not shown).

The control signal makes a predetermined sensor group (not shown) active for monitoring transfer or transfer and lateral movement of the printing plate at the designated one of the stage positions 102, 103 and 104. In conjunction therewith, the driving means 7 or 42 for the vertical transporting means A or B starts driving. It should be noted that, in the foregoing discussion for the operation, one of the stage positions 102, 103 and 104 should be understood as the initial position 101 or one of the stage positions 102, 103 and 104 in the case of the embodiment illustrated in FIG. 2.

In the following discussion for the operation, the operation in the case of the vertical transporting means A in the embodiments of FIGS. 1 and 2 will be discussed initially, and then the operation in the case of the vertical transporting means B in the embodiment of FIG. 8 will be discussed.

In the case of the vertical transporting means A and if the second stage position 102 or the fourth stage position 104 is designated, the carrier 10 with the loaded printing plate PL is driven to elevate to the elevation corresponding to the designated second stage position 102 or the fourth stage position 104 by the driving means 7. An appropriate sensor may monitor the movement of the carrier 10 so that the driving means 7 is stopped when the carrier 10 reaches the level of the temporary holding member 21 and the support rail 22 of the designated second or fourth stage position 102 or 104. At this condition, the carrier 10 is placed at the position illustrated by the two dotted line.

When the carrier 10 is designated for one of the second stage position 102 or the fourth stage position 104, the actuation member 13*a* provided at the tip end of the carrier pivoting means 13 provided on the carrier support 3 at the second or fourth stage position 102 or 104 engages with the projecting actuation member 11 provided at the pivoted end of the carrier 10.

Then, the carrier pivoting means 13 is expanded. By this, the carrier 10 is pivoted over approximately 90° and thus is placed at the pivoted position. By this angular displacement, the carrier 10 is aligned with the temporary holding member 21 and the support rail 22.

During this pivotal movement of the carrier 10, a sensor monitors the angular displacement of the carrier to produce a sensor signal to be supplied to the control means. When the carrier 10 completes angular displacement over approximately 90°, the driving means 18 responds to the sensor signal to initiate driving. By this, the receiving carrier 20 which is initially placed at a stand-by position, is driven to move toward the carrier 10 along the receiving carrier beam 11 to reach the predetermined position back side of the printing plate PL. The motion of the receiving carrier 20 is also monitored by an appropriate sensor. The sensor produces the sensor signal indicative of the receiving carrier position. When the receiving carrier 20 reaches the predetermined position set forth above, the driving means 18 terminates driving in response to the sensor signal. At the same time, the sucker member as the printing plate receiving member 19 sticks and holds the printing plate PL. The operation of the printing plate receiving member 19 is also monitored by an appropriate sensor.

Upon completion of sticking and holding of the printing plate, the sensor monitoring the operation of the printing plate receiving member 19 outputs a sensor signal. The driving means 18 is responsive to this sensor signal to initiate driving in the reverse direction to move the receiving carrier 20 with the printing plate PL to the temporary holding member 21. This motion of the receiving carrier is monitored by the sensor set forth above, which sensor produces the sensor signal indicative of the fact that the receiving carrier 20 reaches the position corresponding to the temporary holding member 21. Then, the printing plate receiving member 19 is deactivated to release the printing plate PL and transfers to the temporary holding member 21. The temporary holding member 21 temporarily holds the printing plate PL. At the same time, the receiving carrier 20 is rested in place in a stand-by state. On the other hand, once the printing plate PL is transferred to the printing plate receiving device 15, the carrier 10 is pivoted back to the initial position as illustrated by the two dotted line and oriented substantially perpendicular to the longitudinal axis of the plate cylinder by reverse operation of the actuation means 13 of the vertical transporting means A, Thereafter, the carrier 10 is moved down to the initial position 101 with the vertical transporting means A by reverse driving of the driving means 7. Reaching of the initial position 101 of the carrier 10 is detected by the sensor. In response to the sensor signal indicative of the carrier 10 reaching the initial position 101, the driving of the driving means 7 is terminated.

When a plurality of temporary holding members are arranged in an overlapping manner, the driving means 23 is actuated (see FIG. 5) in response to the common sensor signal to that act for releasing the printing plate PL. By this, the temporary holding members are selectively placed for temporarily holding the printing plate PL. By repeating this operation, the printing plates PL are temporarily held on the temporary holding members.

In the embodiment as illustrated in FIG. 2, the operations similar to those set forth above are performed at any of the initial position 101 and the second to fourth stage positions 102, 103 and 104.

In case of the vertical transporting means A in the embodiment of FIG. 1 and if the third stage position 103 is designated, the driving means 7 is initiated for driving in response to the control signal. In conjunction therewith, the driving means 33 of the printing plate receiving device 24 is actuated to expand a rod. By the action of the driving means 33, the transfer member 32 is moved across the vertical movement region of the carrier 10.

When the carrier 10 reaches the third stage position 103, namely the position to transfer the printing plate PL from the carrier 10 to the transfer member 32, the movement of the carrier 10 is monitored by the sensor set forth above. In response to the sensor signal indicative of the fact that the carrier reaches the third stage position 103, the driving means 7 is terminated in operation at the initial position, in which the carrier axis extends perpendicular to the longitudinal axis of the plate cylinder. The carrier 10 at this position is illustrated by the solid line.

Figure 7:
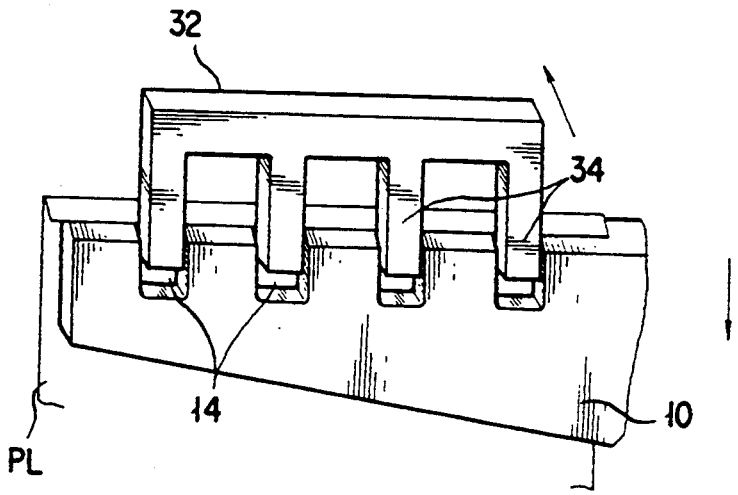
FIG. 7 is a perspective view showing a manner of transferring of a printing plate between the carrier and a transfer member in the embodiment of FIG. 1.

Subsequently, when the rod of the actuation means 33 is contracted to the intermediate position, so that the transfer member 32 is shifted at a position aligned with the carrier 10. At this time, a plurality of rake-shaped projecting portions 34 of the transfer member are received within the cut-out 14 of the carrier 10, as shown in FIG. 7.

When the driving means 33 completes the stroke up to the intermediate position, the sensor monitoring activity of the driving means outputs the sensor signal indicative thereof. In response to this sensor signal, the driving means 7 initiates driving in the reverse direction. By this, the carrier 10 transfers the printing plate PL to the transfer member 32 and then returns to the initial position 101 at the lowermost stage. When the carrier 10 is elevated down to a predetermined stroke, the sensor monitoring the motion of the carrier 10 detects the fact to output the sensor signal. In response to this, the driving means 33 again initiates driving to completely retract the rod. By the action of the driving means, the transfer member 32 is placed in alignment with the temporary holding member 31.

The complete retraction of the rod of the driving means 33 is detected by the sensor monitoring the activity of the driving means. Then, the sensor signal indicative of the completion of the retracting motion of the driving means 33 initiates driving of the driving means 28. Then, the receiving carrier 30 maintained in the stand-by state is driven to move toward the transfer member 32 to place the printing plate receiving member 29, such as the sucker member, at the predetermined position back side of the printing plate PL. The sensor monitoring the motion of the receiving carrier 30 detects the fact that the printing plate receiving member 29 reaches the predetermined position to issue the sensor signal. In response to this sensor signal, the driving means 28 terminates driving. At this position, the printing plate receiving member 29 sticks on the printing plate PL for holding the same.

When holding of the printing plate PL by the printing plate receiving member 29 is completed, the sensor monitoring the action of the printing plate receiving member issues the sensor signal to cause driving of the driving means 28 in the reverse direction. By reverse driving of the driving means 28, the receiving carrier 30 carries the printing plate PL to the temporary holding member 31. Reaching of the receiving carrier 30 to the temporary holding means is detected by the sensor monitoring the motion of the receiving carrier. In response to the sensor signal of this sensor, the driving means 28 terminates driving and the printing plate receiving member 29 releases the printing plate PL to transfer to the temporary holding member 31. The temporary holding member 31 temporarily holds the printing plate PL thus transferred. The receiving carrier 30 is then placed into the stand-by state in place.

On the other hand, in the system where the transfer member 32 is carried with the receiving carrier 30 so that the printing plate PL is directly transferred from the transfer member 32 to the temporary holding member 31, the transfer member 32 is moved upwardly to the extent to pass across the temporary holding member 31 therebelow by a not shown driving means which initiates driving in response to the sensor signal produced upon completion of secondary retraction (completion of retraction) of the driving means 33. The upward movement of the transfer member 32 is detected by a sensor to produce a sensor signal. The driving means 28 is responsive to this sensor signal to initiate driving in the reverse direction. By reverse driving of the driving means 28, the transfer member 32 while carrying the printing plate PL is moved to the position aligning with the temporary holding member 31. When the transfer member 32 is aligned with the temporary holding member 31, the sensor monitoring the motion of the transfer member 32 detects this fact and outputs the sensor signal. In response to this sensor signal, the driving means 26 terminates driving, and not shown driving means is actuated to lower the transfer means 32 to engage the rake-shaped projection 34 to the cutouts (not shown) of the temporary holding member 31 to transfer the printing plate PL to the temporary holding member 31.

The transfer member 32 which transferred the printing plate PL to the temporary holding member 31 waits for an appropriate movement of the temporary holding member 31, or for displacement of the printing plate PL from the temporary holding member 31, to initiate driving of the driving means 28. By driving of the driving means 28, the transfer member 32 is returned to the stand-by position (the position shown in FIG. 1).

When the temporary holding members are arranged in the overlapping manner, not shown actuation means is actuated to selectively place the temporary holding members at the position where the printing plate is transferred from the transfer member to the temporary holding member. By repeating this sequence of operations, the printing plates PL can be temporarily held in each of the temporary holding members.

Next, discussion will be given for the operation of the vertical transporting means B illustrated in FIG. 8. In case of the vertical transporting means B, the vertical transporting means is cooperated with the printing plate receiving device 24 or equivalent printing plate receiving devices. Accordingly, in either stage positions 102, 103, 104 above the initial position 101, the printing plate receiving device 24 or equivalent printing plate receiving device is employed. Therefore, at each of all stage positions, identical operations are performed. Therefore, discussion will be given hereinafter for the same where the third stage position 103 is designated.

Initially, in response to the control signal output from the control means, the driving means 42 initiates driving. In conjunction therewith, the driving means 33 of the printing plate receiving device 24 starts actuation to expand the rod. In response to this, the transfer member 32 is moved across the region of vertical motion of the carrier 43 to be placed at the predetermined position.

When the carrier 30 reaches the predetermined position at the third stage position 103, which predetermined position corresponds to the position where the printing plate PL is transferred from the carrier 43 to the transfer member 32, the driving means 42 terminates driving in response to the sensor signal from a sensor monitoring the motion of the carrier 43. Thus, the carrier 43 stops at the predetermined position.

Subsequently, the rod of the driving means 33 is retracted to the intermediate position to move the transfer member 32 at a position where the transfer member 32 and the carrier 43 are placed in alignment with each other. At this time, a plurality of rake-shaped projection 34 of the transfer member 32 engages with the cut-outs 45 of the carrier 43.

When the stroke of the driving means 33 to retract the rod at the intermediate position is completed, the sensor signal of the sensor monitoring the operation of the driving means 33 is output to drive the transfer member 32 upwardly to the height position, where the transfer member 32 passes over the carrier 43.

Subsequently, when the upward motion of-the transfer member 32 is completed, the sensor signal indicative of this fact is issued by the sensor monitoring the motion of the transfer member. In response to the sensor signal, the driving means 33 is again initiates driving to place the rod of the driving means 33 in a fully retracted position so that the transfer member 32 is shifted to be placed in alignment with the temporary holding member 31. In conjunction therewith, the driving means 42 drives the subsequent carrier 43 to the initial position 101. When the rod of the driving means 33 is fully retracted, the driving means (not shown) for driving the transfer member 32 vertically initiates driving in the reverse direction to lower the transfer member 32. By this, the transfer member 32 is aligned with the temporary holding means 31 at the common horizontal plane.

When alignment of the transfer member 32 and the temporary holding member 31 is completed, the sensor signal output from the sensor monitoring the motion of the transfer member 32 initiates driving of the driving means 28, Then, the receiving carrier 30 which is initially placed at the stand-by position initiates traveling. The receiving carrier 30 moves toward the transfer member 32 along the receiving carrier beam 26 to place the printing plate receiving member 29, such as the sucker member, at the predetermined position back side of the printing plate PL. This position of the printing plate receiving member 29 is detected by the sensor monitoring the motion of the printing plate receiving member 29. Then, the sensor outputs the sensor signal. In response to this sensor signal, the driving means 28 terminates driving. In conjunction therewith, the printing plate receiving member 29 sticks the printing plate PL to hold.

When the printing plate PL is held on the printing plate receiving member 29, the sensor monitoring the action of the printing plate receiving member issues the sensor signal. In response to this sensor signal, the driving means 28 is driven in the reverse direction so that the receiving carrier 30 transports the printing plate PL to the temporary holding member 31. When the receiving carrier 30 reaches the temporary holding member 31, the sensor monitoring the motion of the receiving carrier 30 outputs the sensor signal indicative thereof. In response to this sensor signal, the driving means 28 terminates driving. At the same time, the printing plate receiving means 30 releases the printing plate PL to transfer the same to the temporary holding member 31. The temporary holding member 31 thus temporarily holds the printing plate PL. After transferring the printing plate PL to the temporary holding means, the receiving carrier 30 stays in place in a stand-by state.

In the case where the printing plate receiving device 24 is constructed such that the transfer member 32 is carried by the receiving carrier 30 so that the printing plate PL is directly transferred from the transfer member 32 to the temporary holding member 31, the printing plate receiving device 24 may cooperate with the vertical transporting means B. The operation in this case should be obvious to those skilled in the art and thus will not be discussed for avoiding unnecessary redundant disclosure.

Through the operations set forth above, the printing plate PL loaded to the carrier 10 or 43 at the initial position 101 is carried to the desired stage position 102, 103 or 104 by means of the vertical transporting means A or B. At the designated stage position, the printing plate PL is transferred from the vertical transporting means A or B to the machine pate receiving device 15 or 24 and then temporarily held by the temporary holding member 21 or 31.

At this condition, the personnel at respective floor or platform installs the temporarily held printing plate to the plate cylinders at respective printing stages $P_1$, $P_2$, $P_3$ and $P_4$. In the alternative, the printing plate PL may be automatically installed on the plate cylinders at respective printing stages $P_1$, $P_2$, $P_3$ and $P_4$ by means of the automatic printing plate installation device PA.

It should be noted that, in the operations set forth above, when transportation of the printing plate PL is commanded by designating the desired stage position 102, 103 or 104 while the printing plate PL which is previously transported, is stilled held temporarily by the temporary holding member 21 or 31, not shown alarm may be triggered for providing an alarm.

In the disclosure set forth above, respective sensors monitoring operations of various components of the printing plate delivery system can be constructed with known sensors. However, the foregoing disclosure has been directed to monitor actions and motions of the components of the system by means of the sensors, it should be possible to detect various operational positions of various components concentrically by the control means with employing the numerical control technologies, such as by monitoring the driving magnitude of various driving means. Such modification should be understood as falling within the scope of the invention. Also, it should be possible to perform the foregoing sequences of operations with managing by a sequencer.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A printing plate delivery system for a multi-stage printing press, in which a plurality of printing stages are arranged in a vertical direction, comprising:

a vertical transporting means having a carrier movable in said vertical direction between a loading position where a printing plate is set along the height direction of said printing press being loaded and a plurality of mutually different height levels of printing plate transfer positions at the corresponding height positions of said printing stages for selectively transferring the printing plate to and from said printing plate transfer positions; and receiving means provided corresponding to each of said printing stages and cooperated with said vertical transporting means for receiving said printing plate from said carrier at the corresponding transfer position.

2. A printing plate delivery system in a printing press having a plurality of printing stages arranged vertically for delivering printing plates to plate cylinders in respective printing stages, the system comprising:

a vertical transporting passage extending vertically in the vicinity of said printing press across a first printing plate loading position and a plurality of first printing plate unloading positions which correspond to respective height positions of said plate cylinders and defining a printing plate transporting passage;

at least one vertical carrier device movable along said vertical transporting passage across said first printing plate loading position and a plurality of printing plate unloading positions at mutually different height levels while carrying said printing plate loaded at said first printing plate loading position for delivering a desired one of said printing plate unloading positions;

a plurality of horizontal transporting passages each extending, in a substantially horizontal direction along the longitudinal axis of said printing cylinder at each printing stage across said unloading position; and a plurality of horizontal carrier devices each movable along said horizontal transporting passage between a second printing plate loading position corresponding to said first printing plate unloading position and a second unloading position for transporting the printing plate transferred from said vertical carrier device to desired horizontal position while opposing the printing plate with said plate cylinder and transfer to said plate cylinder; and a temporary holding means for temporarily holding said printing plate transferred to said horizontal carrier at said printing plate loading position.

3. A printing plate delivery system for a multi-stage printing press, in which a plurality of printing stages are arranged in a vertical direction, comprising:

a vertical transporting means having a carrier movable in said vertical direction between a loading position where a printing plate is set along the height direction of said printing press being loaded and a printing plate transfer position at the corresponding height positions of said printing stages for transferring the printing plate;

receiving means provided corresponding to each of said printing stages and cooperated with said vertical transporting means for receiving said printing plate from said carrier at the corresponding transfer position; and a temporary holding means for temporarily holding said printing plate transferred to said receiving means.

4. A printing plate delivery system as set forth in claim 3, wherein said receiving means incorporates said temporary holding means.

5. A printing plate delivery system for a multi-stage printing press, as set forth in claim 1, further comprising horizontal transporting means corresponding to each printing stage and cooperated with said receiving means for transporting said printing plate substantially in a horizontal direction.

6. A printing plate delivery system as set forth in claim 2, wherein said horizontal transporting means is incorporated in said receiving means.

7. A printing plate delivery system as set forth in claim 5, wherein said horizontal transporting means transports said printing plate in a direction which is substantially parallel to a longitudinal axis of a plate cylinder in said printing stage.

8. A printing plate delivery system as set forth in claims 5, which further comprises a temporary holding means for temporarily holding said printing plate horizontally transported by said horizontal transporting means.

9. A printing plate delivery system in a printing press having a plurality of printing stages arranged vertically for delivering printing plates to plate cylinders in respective printing stages, the system comprising:

a vertical transporting passage extending vertically in the vicinity of said printing press across a first printing plate loading position and a plurality of first printing plate unloading positions which correspond to respective height positions of said plate cylinders and defining a printing plate transporting passage;

at least one vertical carrier device movable along said vertical transporting passage across said first printing plate loading position and a plurality of printing plate unloading positions at mutually different height levels while carrying said printing plate loaded at said first printing plate loading position for delivering a desired one of said printing plate unloading positions;

a plurality of horizontal transporting passages each extending in a substantially horizontal direction along a longitudinal axis of said printing cylinder at each printing stage across said unloading position; and a plurality of horizontal carrier devices each movable along said horizontal transporting passage between a second printing plate loading position corresponding to said first printing plate unloading position and a second unloading position for transporting the printing plate transferred from said vertical carrier device to a desired horizontal position while opposing the printing plate with said plate cylinder and transfer to said plate cylinder.

10. A printing plate delivery system as set forth in claim 8, wherein said vertical carrier device carries said printing plate while directing the printing plate in an angled orientation with respect to a plane extending across the longitudinal axis of said plate cylinder, and said horizontal carrier device carries said printing plate while directing the printing plate in substantially parallel orientation with respect to said plane, and which system further comprises an orienting mechanism interposed between said vertical carrier device and said horizontal carrier device for converting orientation of said printing plate from said angled orientation to said parallel orientation.

11. A printing plate delivery system as set forth in claim 10, wherein said orienting mechanism is incorporated in said vertical carrier device for pivoting the carrier device between said angled position and said parallel position together with said printing plate.

12. A printing plate delivery system as set froth in claim 10, wherein said orientating mechanism is incorporated in said horizontal carrier device for reorienting said printing plate from said angled position to said parallel position.

13. A printing plate delivery system as set forth in claim 10, wherein a plurality of said horizontal carrier device is arranged so that one of said horizontal carrier devices is selectively placed at said second loading position for receiving said printing plate.

14. A printing plate delivery system in a printing press having a plurality of printing staged arranged vertically for delivering printing plates to plate cylinders in respective printing stages, the system comprising:

a vertical transporting passage extending vertically in the vicinity of said printing press across a first printing plate loading position and a plurality of first printing plate unloading positions which correspond to respective height positions of said plate cylinders and defining a printing plate transporting passage;

a plurality of said vertical carrier devices are movably supported on said vertical transporting passage in a mutually spaced apart relationship for permitting one-way circulating movement of said vertical carrier devices across said first loading position and said first unloading positions;

a plurality of horizontal transporting passages each extending in substantially horizontal direction along the longitudinal axis of said printing cylinder at each printing stage across said unloading position; and a plurality of horizontal carrier devices each movable along said horizontal transporting passage between a second printing plate loading position corresponding to said first printing plate unloading position and a second unloading position for transporting the printing plate transferred from said vertical carrier device to a desired horizontal position while opposing the printing plate with said plate cylinder and transfer to said plate cylinder.

* * * * *